United States Patent [19]

Hwang et al.

[11] Patent Number: 4,793,145

[45] Date of Patent: Dec. 27, 1988

[54] DOOR SHUTTER FOR USE IN A REFRIGERATOR

[76] Inventors: Jae S. Hwang, 923-29, Shinjung 5-Dong, Kangsu-ku; Kyung J. Kim, 124-20, Gahrheebong 1-Dong, Kooroh-ku, both of, Seoul, Rep. of Korea

[21] Appl. No.: 122,182

[22] Filed: Nov. 18, 1987

[30] Foreign Application Priority Data

Aug. 25, 1987 [KR] Rep. of Korea ..... 87-14260

[51] Int. Cl.[4] ..... A47F 3/04

[52] U.S. Cl. ..... 62/252; 62/255; 62/417; 62/441

[58] Field of Search ..... 62/252, 253, 255, 441, 62/417, 440

[56] References Cited

U.S. PATENT DOCUMENTS

| | | | |
|---|---|---|---|
| Re. 20,300 | 3/1937 | Warren | 62/417 X |
| 1,628,083 | 5/1927 | Vogt | 62/441 X |
| 1,926,718 | 9/1933 | Fredberg | 62/252 |
| 2,127,379 | 8/1938 | Adams | 62/440 X |
| 2,139,779 | 12/1938 | Stratton | 62/440 X |
| 2,399,967 | 5/1946 | West et al. | 62/441 X |
| 2,459,243 | 1/1949 | Schwartz | 62/255 X |
| 2,470,956 | 5/1949 | Savidge | 62/441 |

*Primary Examiner*—Lloyd L. King

*Attorney, Agent, or Firm*—Birch, Stewart, Kolasch & Birch

[57] ABSTRACT

A refrigerator including a plurality of chambers and door shutters which are suspended on guide rails disposed under chamber partitions for slidably moving to open or close the chambers. The door shutters may be made of a flexible transparent material such as plastic or the like.

8 Claims, 2 Drawing Sheets

DOOR SHUTTER FOR USE IN A REFRIGERATOR

BACKGROUND OF THE INVENTION

1. Field of the Invention

The present invention relates to a door shutter for use in a refrigerator and more particularly, to individual door shutters for individual chambers, such as a freezer chamber and a cool chamber, in the refrigerator for maintaining a constant internal temperature in the chambers to protect food in cold storage from deteriorating and to maintain the quality of the food.

2. Detailed Description of Prior Art

In many of the refrigerators known in the art, multiple doors are required for a freezer chamber and cool chamber. Such chambers may each have several compartments. When the door is opened and food or food containers are taken out, all food or food containers in cold storage in the chamber contact the warm atmosphere. Accordingly, the food can deteriorate in quality and energy for refrigerating the refrigerator is lost. In order to avoid such disadvantages, each chamber of the prior art refrigerators has an individual door. However, this structure is very complicated and may spoil the beauty of the refrigerator.

SUMMARY OF THE INVENTION

Accordingly, it is an object of the present invention to provide individual door shutters for use in a refrigerator for protecting and preventing internal cold air in chambers in the refrigerator from being contaminated with warm atmospheric air.

Another object of the present invention is to provide a door shutter for each chamber in the refrigerator which slidably moves on guide rails disposed within each of the chambers.

A further object of the present invention is to provide a transparent shutter for allowing a user to see the food in the storages.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a refrigerator including a plurality of chambers and chamber door shutters which are slidably suspended on guiding rails disposed in the refrigerator for slidably moving to open or close the chambers. The door shutters are made of a flexible transparent material such as plastic or the like.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
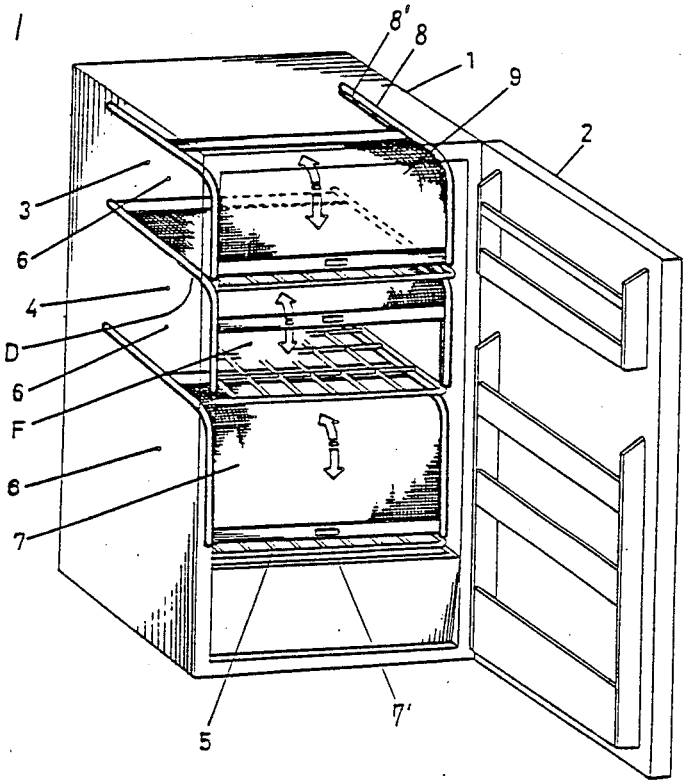
FIG. 1 is a perspective view of a refrigerator including a plurality of door shutters of the present invention.
Figure 2:
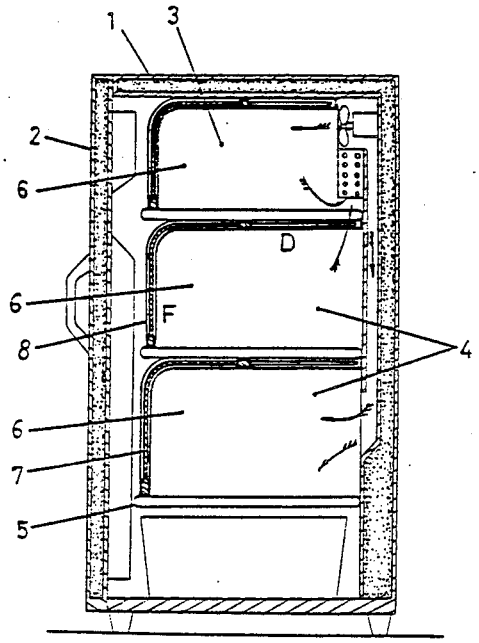
FIG. 2 is a sectional view of the refrigerator including a plurality of door shutters in the closed position according to the present invention.
Figure 7:
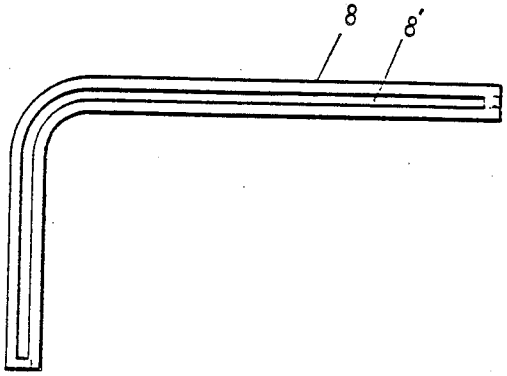
FIG. 7 is a side elevational view of a guiding rail for engaging the shutter of the present invention.

Referring now in detail to the drawings for the purpose of illustrating preferred embodiments of the present invention, the door shutter apparatus for use in a refrigerator as shown in FIGS. 1 and 2 comprises a refrigerator 1, a door 2, a freezer chamber 3, a cool chamber 4, a plurality of shelves 5 for partitioning the chambers 3 and 4 to form a plurality of storages 6 and a plurality of door shutters 7 slidably engaging a pair of guide rails 8. The door shutter 7 has a handle 7' so that a user may close a top portion D and front portion F of the storage 6. The guide rails include a guiding slot for engaging edges of the door shutter 7 (FIG. 7).

Figure 3:
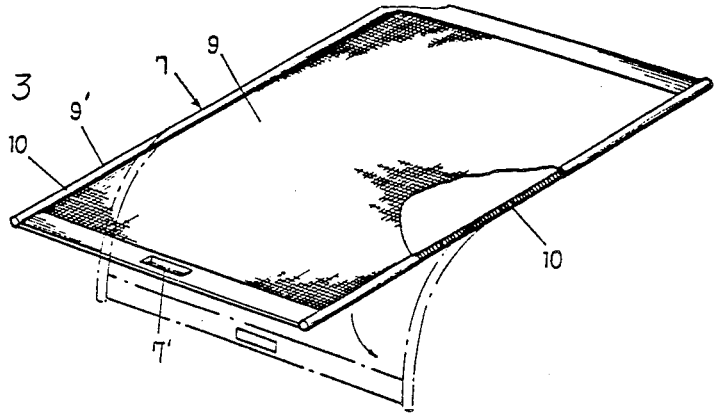
FIGS. 3, 4, 5 and 6 are a perspective view of various alternative shutters of the present invention.

As shown in FIG. 3, the door shutter 7 contains a flexible sheet 9, a pair of rod casings 9' disposed at edges of the sheet 9, and a pair of coiled rods 10 engaged in the pair of rod casings 9'. This door shutter 7 is flexibly moved through L-shaped guide rails 8 as shown in FIG. 1.

Figure 4:
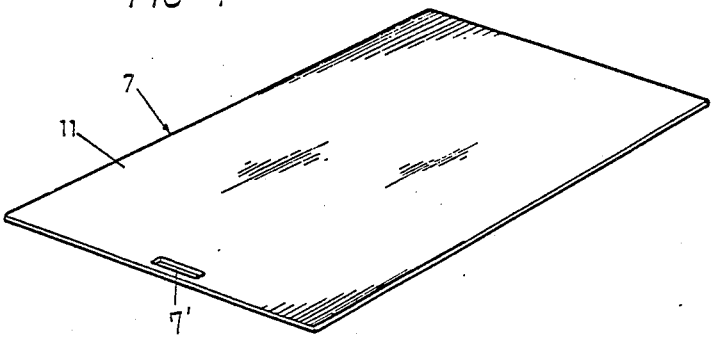

FIG. 4 illustrates a semi-rigid sheet 11 for engaging the pair of guide rails 8.

Figure 5:
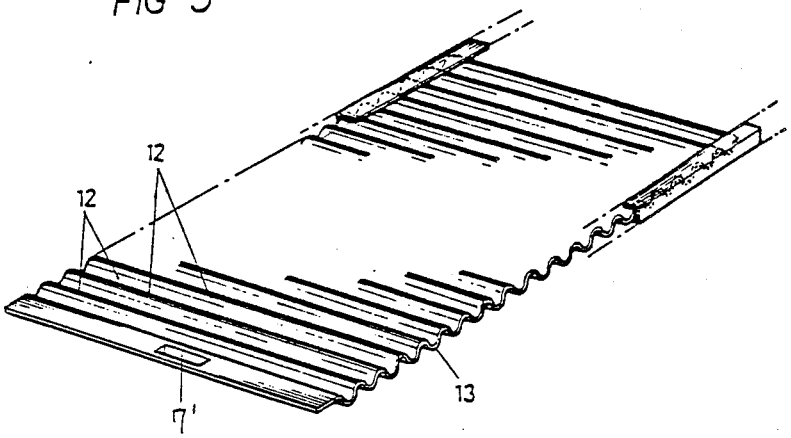

As shown in FIG. 5, the door shutter 7 may have a curved serpentine configuration, which contains a plurality of ridges 12 and valleys 13.

Figure 6:
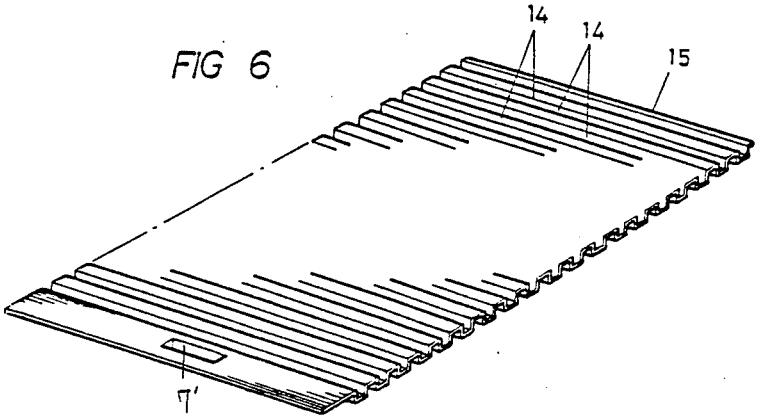

As shown in FIG. 6, the door shutter 7 may have a straight serpentine configuration which contains a plurality of convex portions 14 and concave portions 15.

The door shutter 7 may be made of a transparent material such as plastic or the like to allow a user to see food in the refrigerator.

As shown in FIG. 7, the guiding slots 8 may have a C-shaped configuration for easily engaging the pair of edges of the door shutter 7.

In operation, when the door 2 of the refrigerator 1 is opened, the storages 6 are closed by the plurality of the door shutters 7 so that the internal temperature in the refrigerator 1 cannot change, that is, cannot increase. At this time, all door shutters 7 close the front sides F of the storages 6 and the top sides D of the storages open so that cold temperature can be uniformly maintained in all the storages 6. For example in FIG. 1, when the door shutter 7 disposed at the middle storage 6 is opened, the shutter 7 closes the bottom side of the upper storage 6 so that the warm air cannot circulate into the upper storage 6. Although the cold air in the lower storage 6 can communicate with the warm air in the middle storage 6, the cold air does not circulate into the middle storage 6. Accordingly, the warm atmosphere can contact the cooled air in the middle storage 6 without a large temperature increase.

Table I shows internal temperatures in a refrigerator according to the present invention when compared with a refrigerator disclosed by the prior art when the door opens as follows:

TABLE I

| | A refrigerator of the present invention with a plurality of door shutters | A refrigerator of the prior art without door shutters |
|---|---|---|
| Volume | 200 l | 200 l |
| Door | one | one |
| Temp. of outside | 30° C. | 30° C. |

TABLE I-continued

| | A refrigerator of the present invention with a plurality of door shutters | A refrigerator of the prior art without door shutters |
|---|---|---|
| Temp. before the door opens | 0° C. | 0° C. |
| Immediate temp. as the door is opened | 1.5° C. | 3° C. |
| 1 min. | 2.0° C. | 20° C. |
| 2 min. | 2.5° C. | 20° C. |
| 3 min. | 3.0° C. | 20° C. |
| 4 min. | 3.5° C. | 20° C. |
| 5 min. | 4.0° C. | 25° C. |

As shown in Table I, the refrigerator of the present invention maintains a constant temperature with very little temperature increase even though the door is opened for a long period of time or is frequently opened. In contrast, the refrigerator based on the prior art, i.e. without the door shutters of the present invention, disadvantageously allows for a large increase in internal temperature when the door is opened.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A refrigerator having a door shutter device for use therein which comprises:

at least one refrigerator door operatively associated with said refrigerator for opening and closing said refrigerator, a plurality of food storage chambers disposed in said refrigerator, a plurality of shelves for partitioning said plurality of chambers, a plurality of transparent door shutters for closing and opening each of said chambers, respectively, each of said door shutters having a handle, and a plurality of pairs of L-shaped guide rails disposed above each of said food storage chambers for slidably engaging said door shutters, wherein each of said door shutters opens individually for obtaining access to each of said chambers and wherein the cold temperature in said refrigerator is maintained with high accuracy when said refrigerator door is opened frequently or for long periods of time.

2. The refrigerator having a door shutter device of claim 1 wherein said transparent material is plastic.

3. The refrigerator having a door shutter device of claim 1 wherein said plurality of door shutters comprise a non-flexible sheet, a pair of rod casings disposed at opposite edges thereof, and a pair of coiled rods for engaging said rod casings.

4. The door shutter device of claim 1 wherein the door shutter includes a flexible sheet.

5. The door shutter device of claim 1 wherein the door shutter has a curved serpentine configuration, which contains ridges and valleys.

6. The door shutter device of claim 1 wherein the door shutter has a straight serpentine configuration, which contains a plurality of convex portions and concave portions.

7. The door shutter device of claim 1 wherein the guiding rail contains a guiding slot disposed therein.

8. The door shutter of claim 7 wherein the guiding slot has a C-shaped configuration.

* * * * *